US005855054A

United States Patent [19]

Rivera et al.

[11] Patent Number: 5,855,054

[45] Date of Patent: Jan. 5, 1999

[54] METHOD AND APPARATUS FOR FORMING RIVET JOINTS

[75] Inventors: Benjamin C. Rivera, West Linn; Edwin E. Thompson, Tigard, both of Oreg.

[73] Assignee: Leatherman Tool Group, Inc., Portland, Oreg.

[21] Appl. No.: 898,554

[22] Filed: Jul. 22, 1997

[51] Int. Cl.[6] ..... B21J 15/02; B21J 15/16

[52] U.S. Cl. ..... 29/525.06; 29/434; 29/243.54; 72/391.2; 72/466.4; 72/452.5

[58] Field of Search ..... 29/434, 525.06, 29/243.53, 243.54, 524.1; 72/391.2, 466.4, 466.7, 452.5, 452.6

[56] References Cited

U.S. PATENT DOCUMENTS

| | | | |
|---|---|---|---|
| 1,004,275 | 9/1911 | Kennicott . | |
| 1,177,738 | 4/1916 | Thomson . | |
| 2,925,748 | 2/1960 | Ross | 29/243.54 |
| 3,292,413 | 12/1966 | Falcioni | 72/377 |
| 3,557,442 | 1/1971 | Speller | 29/526 |
| 3,747,193 | 7/1973 | Gregory | 29/243.53 |
| 3,747,194 | 7/1973 | Christensen | 29/234.54 |
| 3,797,365 | 3/1974 | Yoshikawa | 91/402 |
| 3,874,070 | 4/1975 | Falcioni | 29/526 |
| 3,933,025 | 1/1976 | Briles | 29/243.54 X |
| 3,934,330 | 1/1976 | Briles | 29/243.54 X |
| 4,369,907 | 1/1983 | Muhr et al. | 227/54 |
| 4,564,986 | 1/1986 | Peterson | 29/33 |
| 4,659,001 | 4/1987 | Herten | 227/153 |
| 4,854,491 | 8/1989 | Stoewer | 227/58 |
| 4,908,928 | 3/1990 | Mazurik et al. | 29/525.1 |
| 5,136,873 | 8/1992 | Hopkins et al. | 72/452.5 X |

FOREIGN PATENT DOCUMENTS

| | | | |
|---|---|---|---|
| 2-70348 | 3/1990 | Japan | 72/452.5 |

*Primary Examiner*—S. Thomas Hughes
*Attorney, Agent, or Firm*—Chernoff, Vilhauer, McClung & Stenzel

[57] ABSTRACT

A method and apparatus for forming rivet joints that allow pivotal motion of the parts interconnected by such joints with a desired amount of clearance. Parts to be riveted together are aligned with each other and held in place on a parts support anvil, and a rivet is placed into aligned holes. A rivet support anvil is positioned against the head of the rivet to establish an initial condition. The rivet support is adjusted a required amount with respect to the parts support anvil prior to formation of the second head on the opposite end of the rivet. The rivet is allowed to move a controlled amount prior to formation of the second head, to provide the desired amount of clearance.

28 Claims, 9 Drawing Sheets

METHOD AND APPARATUS FOR FORMING RIVET JOINTS

BACKGROUND OF THE INVENTION

The present invention is related to riveting and in particular to forming riveted pivot joints including a desired amount of clearance.

It is common in manufacturing to want a joint in which a rivet serves the dual purposes of both fixing two or more parts together and acting as a pivotal shaft, as in pliers joints, scissors joints, wire cutters, or various types of pinions. Rivet tension or clearance in such a joint is a factor in determining the amount of friction between two or more pivotally interconnected members. In a joint as in a tool such as pliers, it is usually desired to have two or more pivotal members in contact with one another, but not held so tightly together that friction interferes with their use, nor with so much clearance that the two parts of a tool feel loose or sloppy with respect to each other. In the case of scissors or wire cutters, such looseness may detract from the effectiveness of the tool in its primary cutting function. Such a tool with a loose or sloppy rivet joint is commonly perceived as having low quality.

In the past it has been difficult to rivet two parts such as pliers jaws or scissors together with the use of automatic machinery, and final adjustment of such joints has had to be done manually by skilled personnel. Some amount of success has been obtained by using shouldered rivets and then using accurately controlled time and pressure to form a rivet head. In order for controlling time and riveting pressure to be successful, the hardness of rivets must be accurately controlled, and as little pressure as possible must be used, in order to minimize the clamping pressure exerted by the tool forming a rivet head. Unless the parts being connected and the rivets being used are produced to very close tolerances, however, these methods have less than completely satisfactory results, and it is therefore expensive to make such rivet joints.

The most widely used method of controlling the amount of tension or clearance in rivet joints, particularly in tools whose parts pivot with respect to each other, is manual adjustment. Manual adjustment means that after a rivet joint has been formed by machinery, hand tools are used to tighten or loosen the joint as necessary. This often results in inconsistent quality of pivot joints or imperfections in the appearance of a rivet head.

One known method of assembling pliers is disclosed in Thomson U.S. Pat. No. 1,177,738, which teaches use of a spacer of fibrous material interposed between the bearing surfaces while a rivet is formed, and later removal of the spacer to provide the desired amount of clearance between bearing surfaces. This method has not found great acceptance in industry, perhaps because of the difficulty of removing the spacer from between the jaws of tools made using the method.

Christensen U.S. Pat. No. 3,747,194 discloses the use of a preloading clamping pressure to hold together the parts being fastened, before the formation of a rivet head. While this provides reliably tight rivet joints, it is not apparently intended to produce rivet joints including clearance to permit connected parts to pivot.

What is needed, therefore, is an improved method and apparatus for forming rivet joints having a very small, but accurately established, amount of clearance between the parts riveted together, so that the parts are pivotally movable with respect to one another, with neither excessive friction nor excessive clearance, and without the need for manual adjustment.

SUMMARY OF THE INVENTION

The present invention overcomes the aforementioned shortcomings and disadvantages of the prior art by providing a method and apparatus for mechanically forming a riveted pivot joint that interconnects a group of parts and provides a desired amount of clearance that is neither so great that the pivot joint feels sloppy nor so little that it is difficult to pivot the parts with respect to each other about the rivet.

In accordance with the method of the present invention, a group of parts to be riveted together are clamped together and supported by a parts support anvil. A rivet support anvil is used to urge a rivet into an aligned set of rivet holes forming a throughbore to receive the rivet, and an initial condition or preliminary position of the rivet support anvil with respect to the parts support anvil is thereby established. Thereafter the rivet support anvil is adjusted with respect to the parts support anvil, and the opposite end of the rivet is upset to form a head, while the rivet support anvil supports the preformed first head of the rivet independently from the parts support anvil.

The method of the invention may include adjustment of hydraulic or pneumatic pressure utilized to support the rivet support anvil against the pressure of a head forming device.

The method may also include a step of moving the rivet support anvil a predetermined distance from the initial or preliminary position.

The method also may include adjusting a part of a structure supporting the rivet support anvil, thus adjusting an amount of mechanical preloading in the structure's support of the rivet support anvil with respect to the parts support anvil.

In the method of the present invention, the initial condition or preliminary position of the parts support anvil and rivet support anvil with respect to each other compensates automatically for the actual sizes of the rivet and the parts being interconnected, and thus does not rely upon precise manufacture of the parts being joined in order to provide a joint having the required amount of clearance. It should be understood that the desired or required amount of clearance may be zero clearance, and that during the process of forming a rivet the parts being interconnected may be compressed, where the desired or required clearance is an interference or negative clearance resulting in tension in the rivet when the joint has been completed.

The present invention also provides apparatus for forming a rivet joint according to the method of the invention, the apparatus including a parts support anvil, a parts clamp, a rivet support anvil capable of pushing against a first or preformed head of a rivet to force it into a set of aligned rivet holes through the parts to be riveted together, and a mechanism associated with the rivet support anvil, to cause the rivet support anvil to support the rivet relative to the parts support anvil so that when a device is used to form the rivet head on the opposite end of the rivet the rivet joint will have the desired amount of clearance.

Apparatus which is a preferred embodiment of the invention includes a lock to hold the parts clamp, parts support anvil, and rivet support anvil in an initial condition, and a mechanism for adjusting the relationship between the rivet support anvil and the parts support anvil from the initial condition to a condition in which formation of the second head of the rivet provides the required clearance.

Apparatus which is one embodiment of the invention includes a rivet support anvil having a projecting portion, utilized to urge a rivet into an initial position in the parts to be interconnected. The projecting portion is movable a predetermined distance by the rivet under the force exerted to form the second head of the rivet so that another part of the rivet support anvil then supports the first head of the rivet in a position providing the desired amount of clearance in the rivet joint when it is completed.

In one riveting machine embodying the present invention a parts support anvil is movable toward a clamping member and a brake holds the parts support anvil in a fixed position in order to establish the initial condition before adjustment of the rivet support anvil with respect to the parts support anvil.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
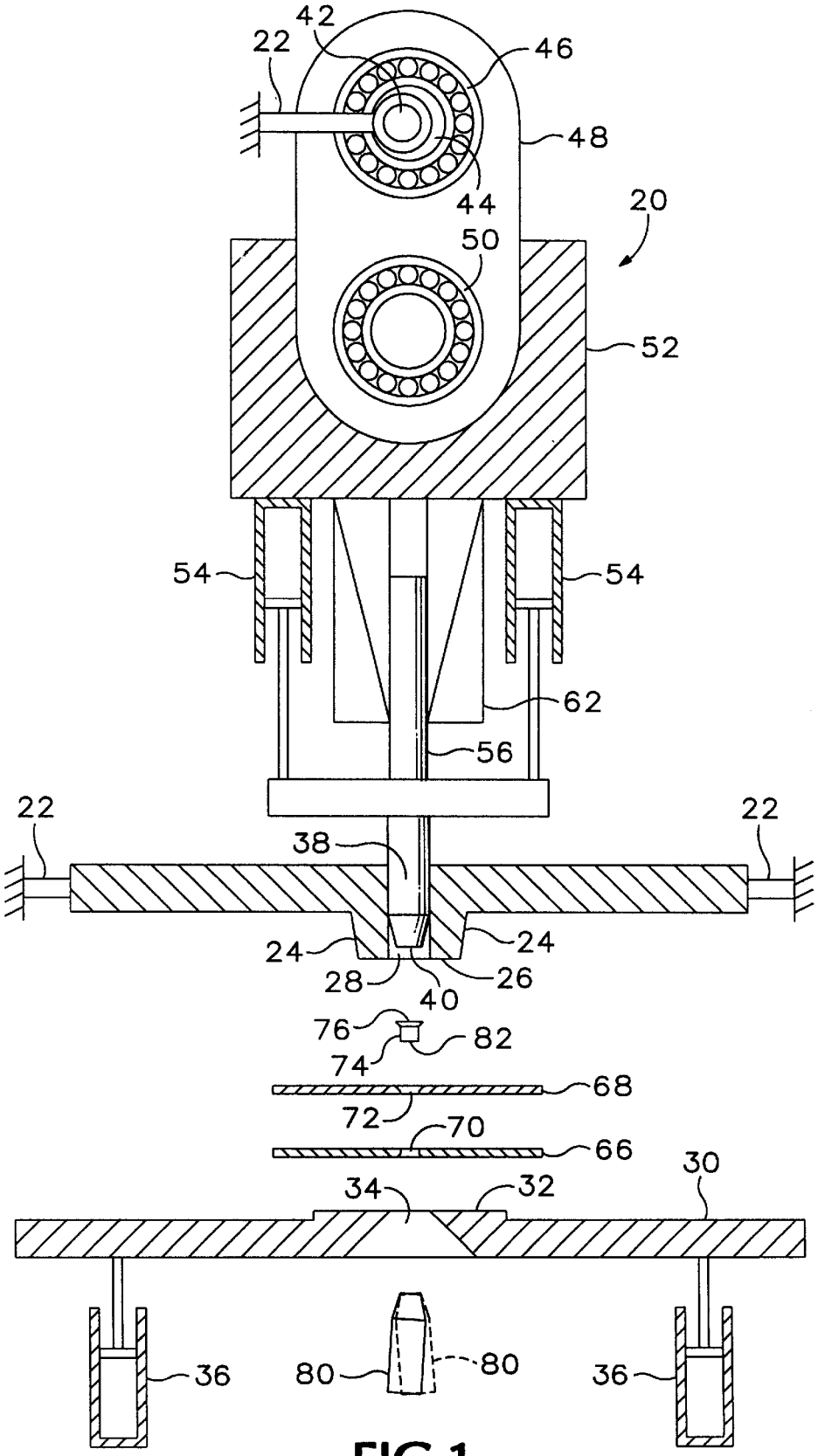
FIG. 1 is a partially sectional schematic drawing of a riveting machine according to the present invention for use in riveting together a pair of parts to provide a desired amount of clearance in the rivet joint formed by the machine.
Figure 2:
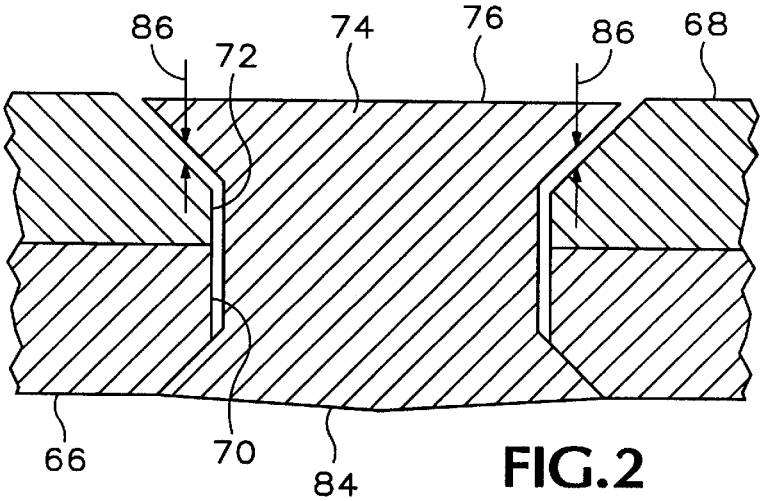
FIG. 2 is a sectional view of parts of a pair of scissors riveted together in accordance with the. present invention, at an enlarged scale.

Referring now to the drawings which form a part of the disclosure herein, a riveting machine 20, shown schematically in FIG. 1, includes a frame 22 shown schematically. A parts support anvil 24 includes a support surface 26 and defines an opening 28 extending through the support surface 26. A parts clamp 30 includes a clamping face 32 and defines a riveting opening 34 extending through the clamping face 32. The parts clamp 30 is movable with respect to the frame 22 by use of a motor arrangement such as pneumatic cylinder-and-piston assemblies 36, of which the cylinders are mounted on the frame 22, while the pistons are connected to the parts clamp 30 to move it toward or away from the parts support anvil 24. The air pressure used in the cylinder-and-piston assemblies 36 is preferably controlled carefully to limit the force exerted by the parts clamp 30. The rate of flow of the air to the cylinder-and-piston assemblies 36 is also controlled to limit the speed of movement of the parts clamp 30. Other motors, also arranged to move at controlled speeds and to exert controlled force may also be used. These might include hydraulic cylinder-and-piston assemblies or ball screw arrangements driven by electric or pneumatic motors with appropriate controls. A cam and follower arrangement driven by a pressurized fluid in a cylinder-and-piston assembly could also be employed to move the parts clamp 30.

A rivet support assembly includes a rivet support anvil 38 that extends through the opening 28 in the parts support anvil 24 and has a rivet head supporting face 40 which is exposed within the opening 28. Preferably, the opening 28 is no larger than necessary to avoid contact with a rivet being used and to provide clearance for the rivet support anvil 38. The rivet support anvil 38 is movable with respect to the parts support anvil 24, so that the locations of the support surface 26 and the rivet head support face 40 with respect to one another are variable.

A shaft 42 is rotatably supported in a set of bearings (not shown) supported in a fixed position with respect to the frame 22. An eccentric wheel 44, equivalent to a crank with a very short throw, is fixedly located on the shaft 42 or formed integrally therewith and is interconnected with a connecting link 48 by a bearing 46 which allows the eccentric wheel 44 to rotate with respect to the connecting link 48. Instead of the eccentric wheel 44, a cam might be used with a follower interconnected with the connecting link 48 so as to move it according to the cam shape and position. Similarly, a screw (not shown) might be supported by the frame 22 and engaged with threads in the connecting link 48 to move it relative to the frame 22.

A bearing 50 mounted in the connecting link 48 a distance apart from the bearing 46 attaches the connecting link 48 to a rivet support anvil carrier 52 which is movable with respect to the frame 22. The anvil carrier 52 is restricted to motion in a straight line with respect to the frame 22, by a ball slide (not shown) or other suitably precise bearings attached to the frame 22.

The rivet support anvil 38 is also restricted to linear movement with respect to the frame 22 by a ball slide or other suitably precise bearings (not shown) and is movable with respect to the rivet support anvil carrier 52 by the use of motors such as pneumatic cylinder-and-piston assemblies 54, of which the cylinders may be mounted on the rivet support anvil carrier 52, while the pistons are connected drivingly to the rivet support anvil 38. The cylinder-and-piston assemblies 54 are arranged to move the rivet support anvil 38 toward and away from the rivet support anvil carrier 52 and thus to move the rivet head support face 40 with respect to the support surface 26 of the parts support anvil 24 through a range of positions limited by the available stroke of the cylinder-and-piston assemblies 54, using conventional valve arrangements (not shown) for control. The portion of the rivet support anvil 38 which extends through the opening 28 remains movable freely and independently with respect to the parts support anvil 24.

The air pressure used in the cylinder-and-piston assemblies 54 is preferably controlled to limit the force exerted by the rivet support anvil 38. The rate of flow of the air to the cylinder-and-piston assemblies 54 is also controlled to limit the speed of movement of the rivet support anvil 38. Other motors, also arranged to move at controlled speeds and to exert controlled force, may also be used. These might include hydraulic cylinder-and-piston assemblies or ball screw arrangements driven by electric or pneumatic motors with appropriate controls.

The rivet support anvil 38 is limited in its movement relative to the anvil carrier 52 by the interaction of a die post 56 attached to the rivet support anvil 38, and a brake 62, which may be a tapered collet chuck, as shown schematically in FIG. 1, that engages the die post 56 to lock the rivet support anvil 38 in a particular position with respect to the rivet support anvil carrier 52 when the brake 62 is activated.

Instead of the die post 56 and brake 62, other mechanisms could be used, such as a hydraulic work rest. If a ball screw and stepper motor combination is used in place of or supplementing the pneumatic cylinder-and-piston motors 54, an electric brake holding the stepper motor in a desired position has enough mechanical advantage through the ball screw that the electric brake on the stepper motor is sufficient to retain the rivet support anvil 38 in a desired position.

Figure 3:
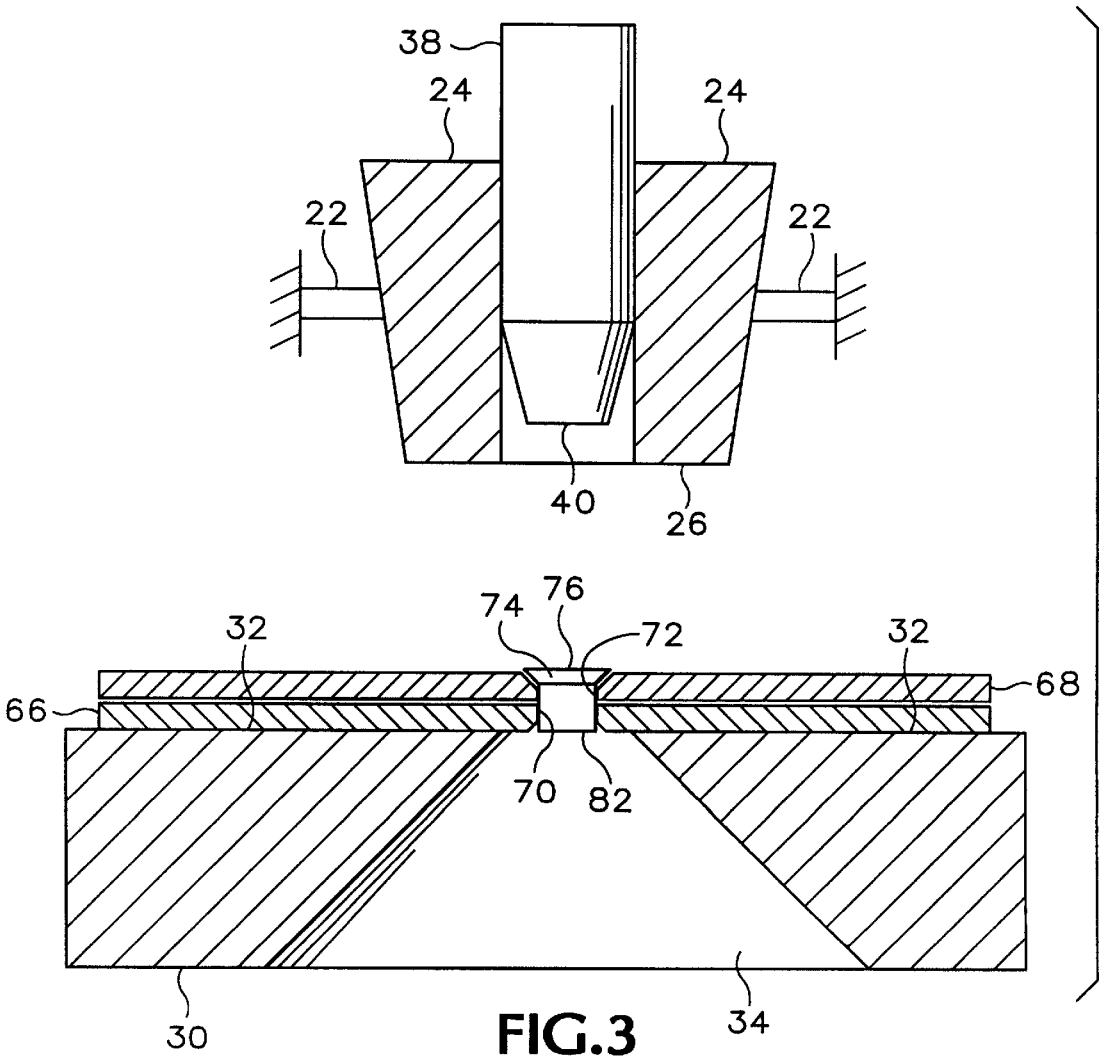
FIG. 3 is a simplified sectional schematic view of basic parts of the machine shown in FIG. 1, at an enlarged scale, showing a first step of a method of forming a riveted joint according to the present invention.
Figure 4:
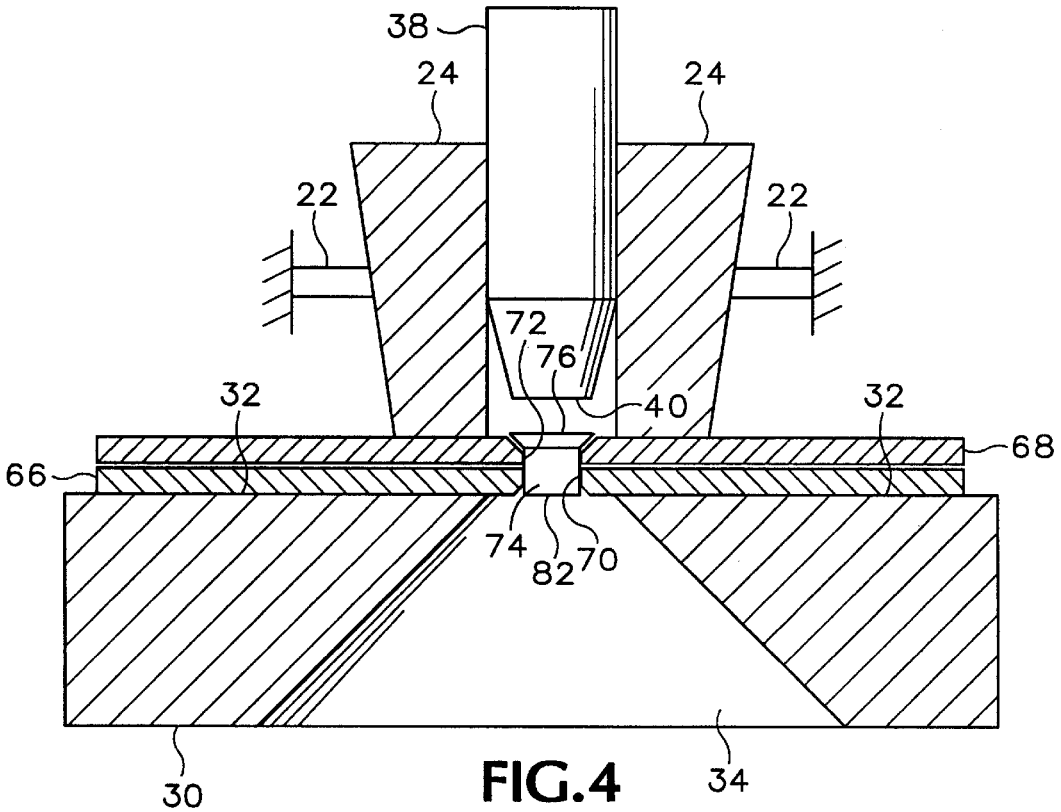
FIG. 4 is a view similar to FIG. 3 showing the positions of parts of the riveting machine shown in FIG. 1 at a subsequent step according to the method of the invention.

Referring now to FIGS. 2–8, parts to be riveted together according to the method of the present invention, such as a first blade 66 and a second blade 68 of a pair of scissors, are placed adjacent one another so that respective rivet holes 70 and 72 are aligned with each other. A rivet 74 is inserted into the through-hole thus defined through the pair of scissors blades by the aligned rivet holes 70 and 72, as shown in FIG. 3. The assembly consisting of the scissors blades 66 and 68 and the rivet 74 is placed between the parts support anvil 24 and the parts clamp 30, in a position where the support surface 26 of the parts support anvil 24 is in contact with the movable blade 68, but does not touch the head 76 of the rivet 74. The rivet hole 72 is chamfered to form a countersink, and the head 76 of the rivet 74 is flat and has an inner side shaped to correspond with the shape of the countersink portion of the rivet hole 72. In other groups of parts to be riveted in accordance with the invention the through-hole might not include a countersink. The parts clamp 30 and parts support anvil 24 are moved toward each other to hold the scissors blades 66 and 68, as by pressurizing the cylinder-and-piston assemblies 36 to move the.parts clamp 30 with respect to the frame 22 to the position shown schematically in FIG. 4, with the rivet 74 helping to keep the parts aligned with one another.

Figure 5:
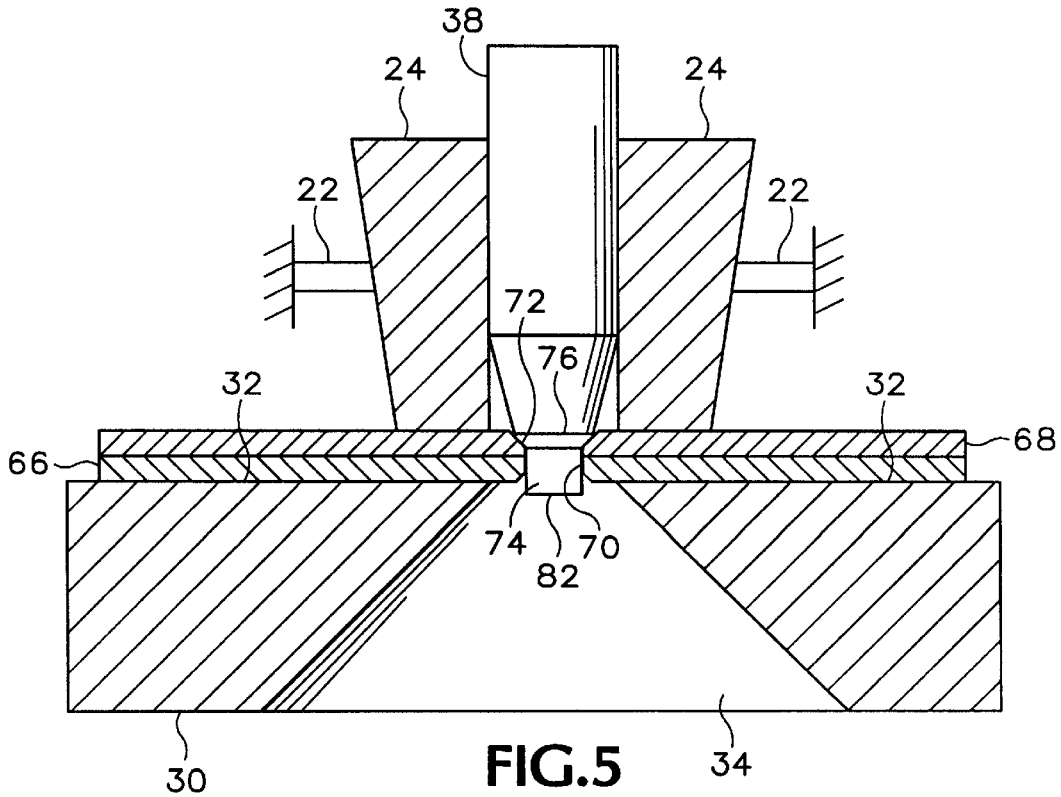
FIG. 5 is a view similar to FIG. 4, showing a further step according to the method of the invention.

At about the same time, the cylinder-and-piston assemblies 54 are also pressurized to move the rivet support anvil 38 as needed to bring its rivet head support face 40 into contact against the head 76 of the rivet 74 as shown in FIG. 5, with a force that is sufficient to urge the rivet 74 snugly into the aligned rivet holes 70 and 72 and bring the head 76 into firm contact with the corresponding surface of the movable blade 68. The force applied to move the rivet support anvil 38 toward the rivet 74 should not be great enough, however, either to deform the rivet 74 or the parts to be joined, or to overcome the force exerted by the parts clamp 30 and urge the scissors blades 66 and 68 away from the parts support anvil's support surface 26.

With the cylinder-and-piston assemblies 36 and 54 exerting pressure the rivet support anvil 38 is in a preliminary position with respect to the parts support anvil 24, and the parts to be riveted and the rivet are all held together with respect to each other by forces whose magnitudes are established by the pressures within the cylinder-and-piston assemblies 36 and 54. The brake 62 is then actuated as a lock to hold the rivet support anvil 38 in that initial condition with respect to the parts support anvil 24. In achieving that initial condition the actual sizes of the parts to be joined, and of the rivet, are accommodated automatically, as the cylinder-and-piston assemblies move as necessary to bring the rivet support anvil 38 to bear on the preformed rivet head 76. Once the brake 62 is actuated the force of the cylinder and piston assemblies 54 may be released.

Figure 6:
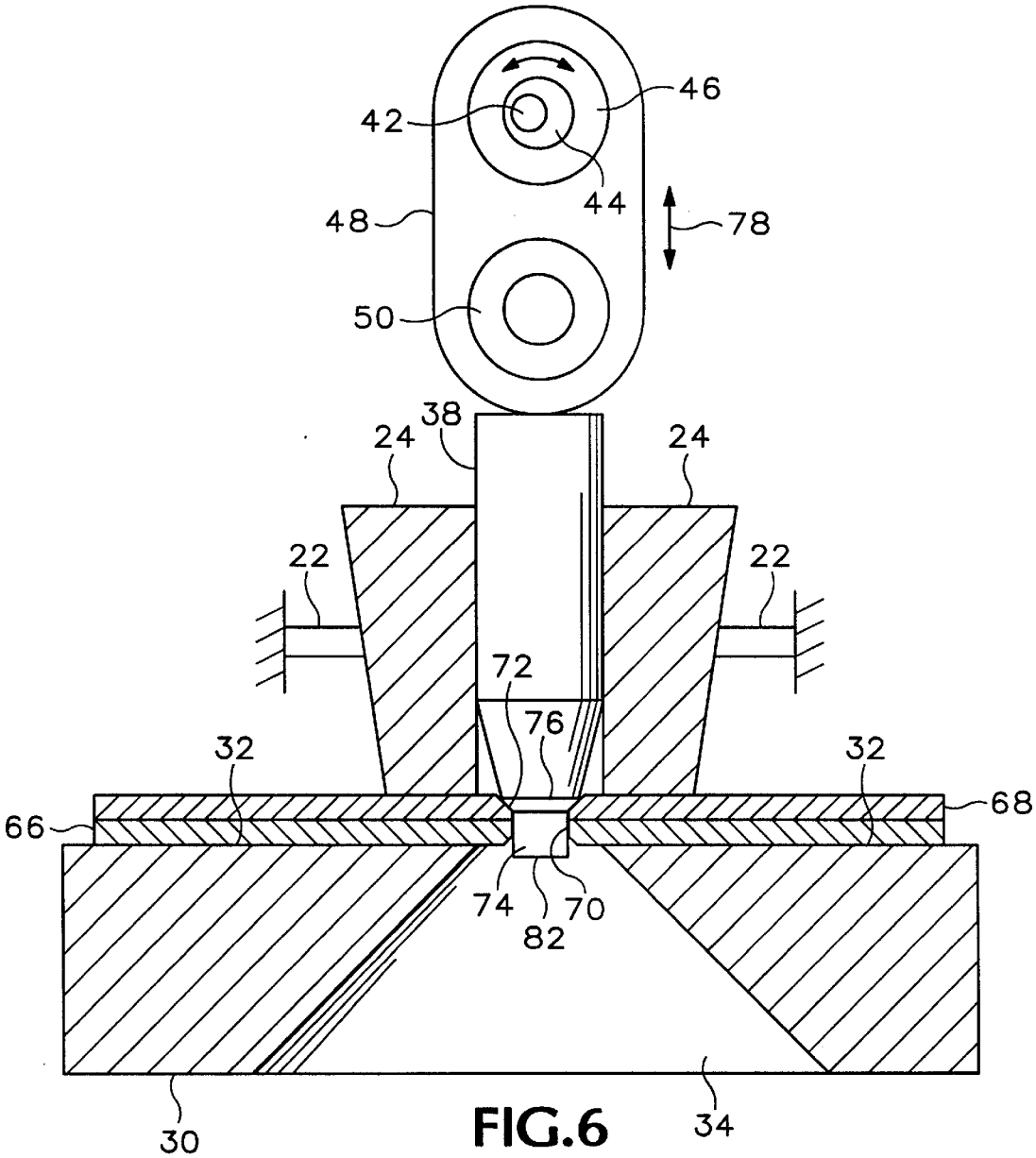
FIG. 6 is a view similar to FIG. 5, showing a further step of the method according to the present invention.

To assure that the pivot joint to be formed holds the blades 66 and 68 together snugly enough so that the scissors will cut; yet not.so tightly that they are difficult to move with respect to each other about the pivot joint, in accordance with the present invention the initial condition of the rivet support anvil 38 and parts support anvil 24 relative to each other is adjusted as indicated schematically in FIG. 6, before a second head is formed on the rivet 74 to interconnect the blades 66 and 68 or other assemblies which might be riveted together. In the riveting machine 20 shown in FIG. 1, this adjustment is accomplished by rotating the shaft 42 through a controlled angle so that the eccentric wheel 44, supported in the connecting link 48 by the bearing 50, changes the position of the connecting link 48 with respect to the frame 22. By the eccentric wheel 44 being eccentric from the shaft 42 by a relatively small distance, for example 0.003 inches, and by carefully controlling the amount of rotation of the shaft 42, the position of the connecting link 48 can be adjusted precisely and reliably by distances controlled to within 0.0001 inch, as indicated by arrow 78.

The required amount of adjustment is determined empirically and is used thereafter in riveting a particular type of assembly, using fairly uniform parts and rivets of known composition. Once the correct amount of adjustment has been determined, the same adjustment of the position of the shaft 42 from the initial condition established as described above will result in the desired amount of clearance in each similar joint made thereafter. For example, in forming a pivot joint in a pair of scissors as described above, the cam shaft 42 may be rotated 60°, to result in movement of the rivet support anvil 38 toward the head 74 of the rivet by a distance of 0.002 inch, preloading portions of the frame 22 to withstand the force of the riveting head 80 against the outer end 82 of the rivet 74, to result in the proper clearance in the pivot joint created.

Figure 7:
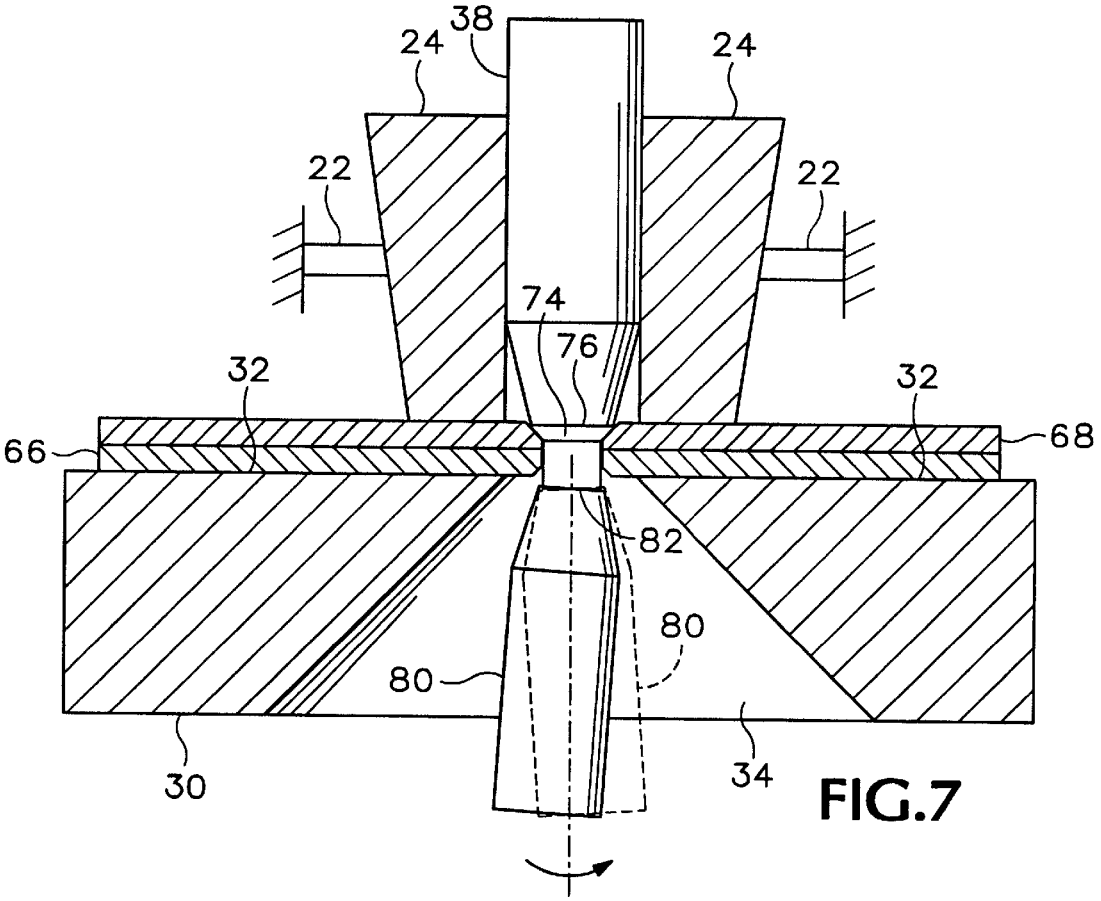
FIG. 7 is a view similar to FIG. 6 at yet a further step according to the present invention, during which a second head is being formed on the rivet.

Once this adjustment has been accomplished, a rivet head-forming device such as a. riveting head 80 is moved into position against the previously headless outer or distal end 82 of the rivet 74, as shown in FIG. 7, urging the rivet 74 toward the rivet support anvil 38 to keep the head 76 firmly in contact with the rivet head support face 40. The riveting head 80 comes into contact with the end 82 of the rivet 74 through the riveting access hole 34 in the parts clamp 30, which provides ample clearance for the riveting head 80 to move about the end 82 of the rivet as necessary to form the second head 84. Since the rivet support anvil 38 prevents the rivet 74 from moving more than a very small distance, the pressure applied by the riveter head 80 upsets the end 82 of the rivet, causing a portion of the body of the rivet 74 to expand radially within the rivet hole 70 and forming a second head 84 on the rivet 74, as shown best in FIGS. 2 and 8. The particular type of riveting head used is not critical, and the riveting head 80 may be a pneumatic or hydraulic orbital riveter, for example.

Figure 8:
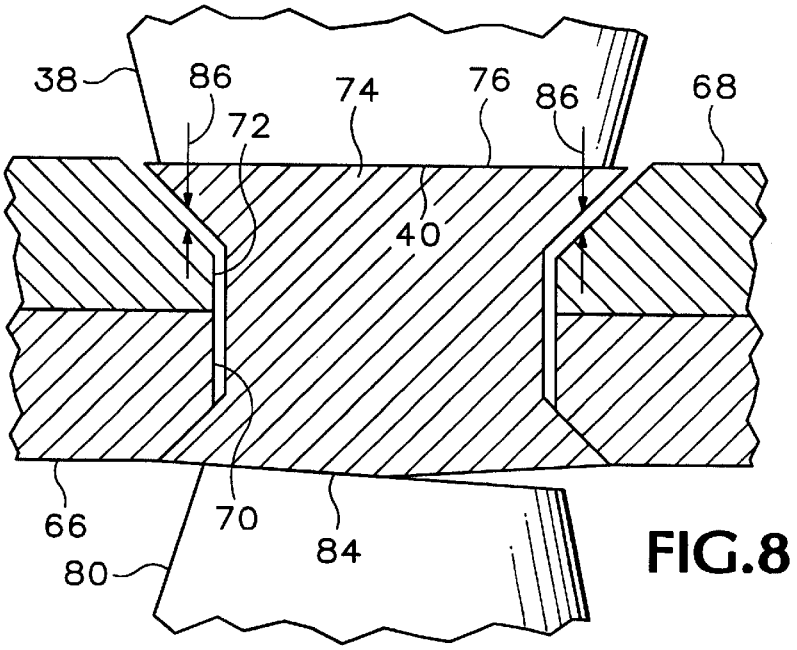
FIG. 8 is a detail view, at a further enlarged scale, showing the rivet joint formed during the step shown in FIG. 7.

Because of the pressure exerted axially along the rivet 74 in forming the second head 84 and because of some expansion of the body of the rivet 74 within the rivet hole 70, the rivet 74 may be fixed in the rivet hole 70, but the previous adjustment of the rivet support anvil 38 results in a certain amount of clearance 86, shown in FIG. 8, between the first or preformed head 76 of the rivet 74 and the adjacent surface in contact with the parts support anvil 24. In FIG. 8, the clearance 86 is shown between the underside of the head 76 and the chamfered surface or countersink part of the rivet hole 72 in the blade 68.

Using the empirically determined amount of adjustment provided by similar rotation of the cam shaft 42 for each similar group of parts once the initial or preliminary condition has been established, the same clearance 86 will be provided when the second head 84 is formed. This requires, however, that the forces exerted in urging the parts clamp 30 against the parts to be assembled and against the parts support anvil 24 and the force exerted by the rivet support anvil 38 in establishing the initial position are reasonably uniform, as may be assured by regulating the pressure utilized in the cylinder-and-piston assemblies 36 and 54. So long as the difference in force exerted by the riveting head 80 is not so great that it overcomes or causes significantly different amounts of flexure in the mechanisms or structures supporting the rivet anvil 38 and the parts support anvil 24 or deforms the parts to be connected by the rivet, the amount of pressure exerted by the riveting head 80 and the dwell time during which the pressure is exerted do not affect the eventual clearance distance 86 which can be obtained. The pressure and dwell time should be kept fairly uniform for a series of rivets, however, to maintain uniformity.

The adjustment of the rivet support anvil 38 with respect to the parts support anvil 24 may not result in actual movement of the rivet support anvil 38 with respect to the parts support anvil 24 when the adjustment is made, because of the elasticity of the frame 22 and the fastenings of the parts support anvil 24 and the cam shaft 42 to the frame 22. It would be expected that if the frame 22 and the connections of the parts support 24 and the cam shaft 42 to the frame were completely rigid there would have to be an adjustment allowing the rivet support anvil 38 to move away from the head 76 of the rivet 74. In fact, because of actual flexibility of the frame 22 or possible backlash in the brake 62, or other such factors, the required adjustment of the rivet support anvil 38 might in some cases be in the direction providing additional preloading of the frame 22 to support the rivet head 76 more firmly, because of the ability of the riveting head 80 to move the rivet support anvil 38 with respect to the parts support anvil 24 when it urges the rivet against the rivet head support face 40 in the process of forming the second head 84. While the clearance distance 86 is shown in the drawings as an actual space between the head 76 and a surface of the blade 68, the desired or required clearance in some cases may be zero, or may be an interference causing some compression of parts being interconnected by a rivet, in order to result in tension in the rivet when formation of the joint has been completed.

Figure 9:
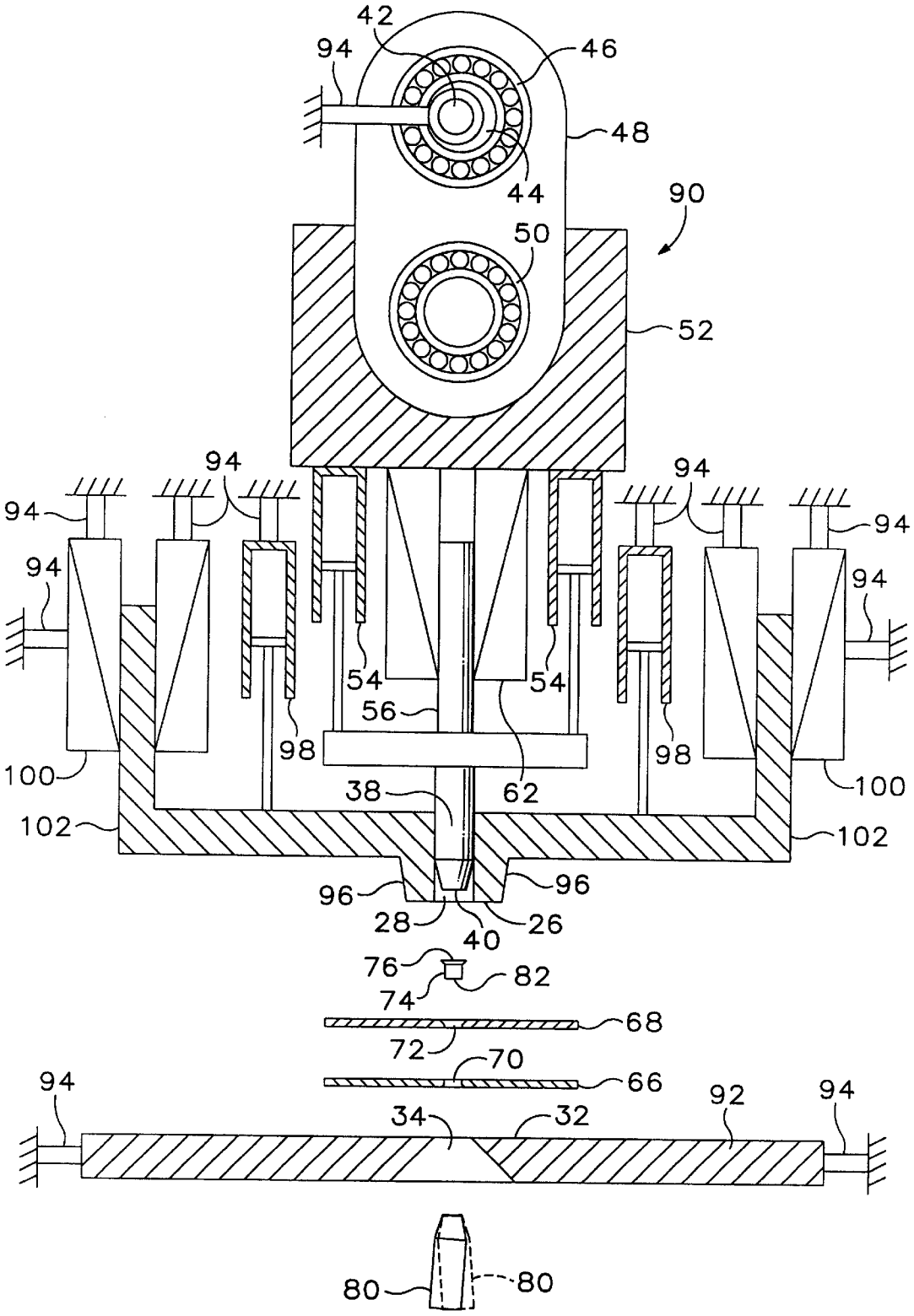
FIG. 9 is a partially sectional, simplified schematic view showing a riveting machine which is an alternative embodiment of the present invention.
Figure 10:
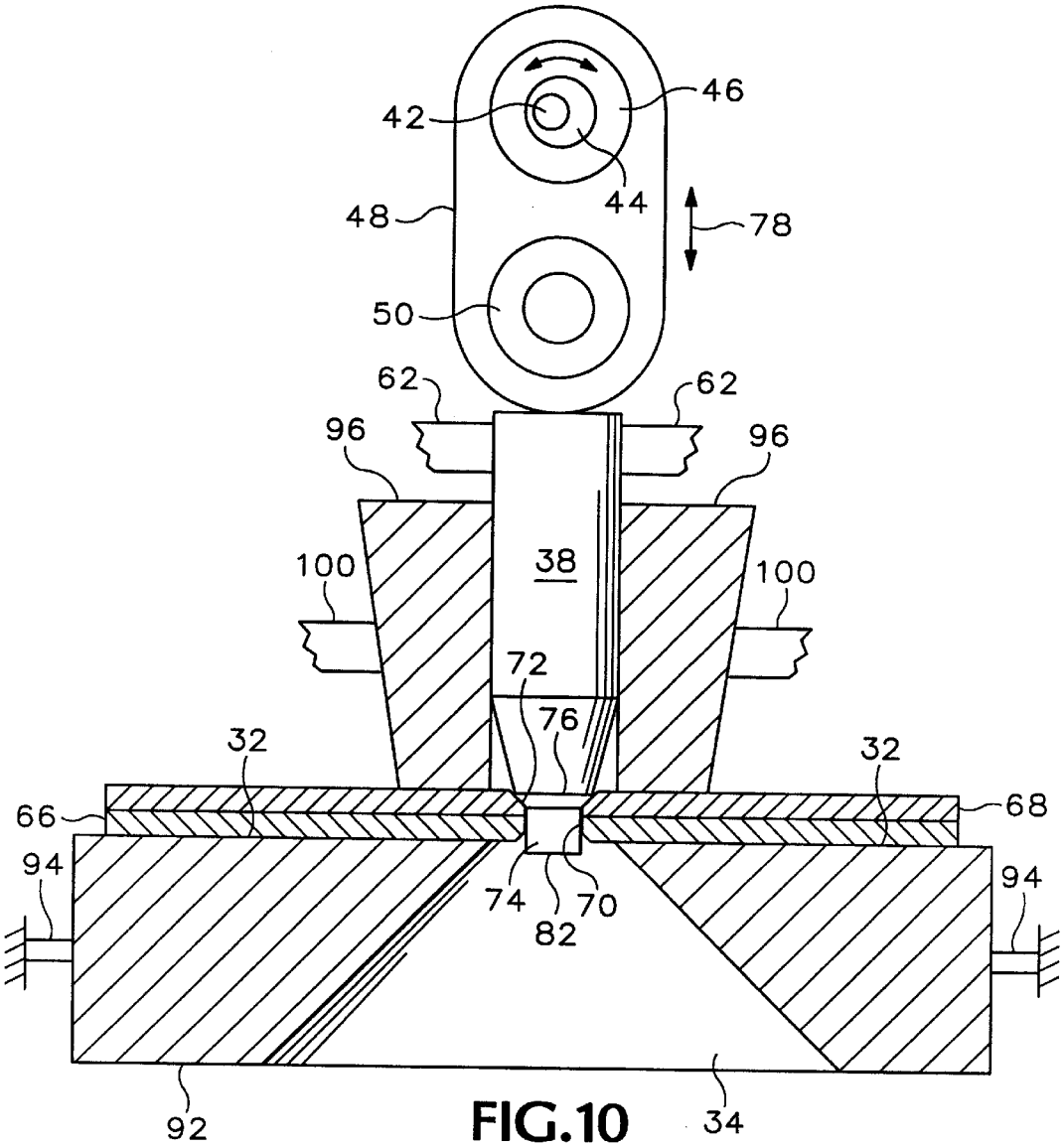
FIG. 10 is a view similar to FIG. 6, showing a step of the process of forming a riveted joint using the machine shown in FIG. 9.

Referring now to FIGS. 9 and 10, a riveter 90 generally similar to the riveting machine 20 shown in FIG. 1 is different in that instead of a movable parts clamp it includes a support table 92 which is fixedly attached to a frame 94, on which the shaft 42 is mounted as on the frame 22 in the riveting machine 20 described previously. A rivet support anvil 38 and associated structures are also connected with the frame 94 as in the riveter 20.

A parts support anvil 96, however, is movable with respect to the support table 92 and with respect to the frame 94, to urge together parts, such as the first blade 66 and second blade 68, to be riveted together as an assembly. Except as will be described presently, the parts support anvil 96 is similar to the parts support anvil 24, and similar parts have been given the same reference numerals used previously with respect to the parts support anvil 24. The parts support anvil 96 is moved toward the support table 92 by motors such as cylinder-and-piston assemblies 98, which correspond generally with the cylinder-and-piston assemblies 36. The cylinder-and-piston assemblies 98 are thus extended by fluid under pressure to move the parts support anvil 96 toward the support table 92 to clamp together a group of parts to be assembled. Brakes 100 which may be similar to the brakes 62 act on die posts 102 attached to and movable with the parts support anvil 96, to lock the parts support anvil 96 into a fixed position with respect to the frame 94 once the parts support anvil 96 has been moved toward the support table 92 by the cylinder-and-piston assemblies 98.

With the parts support anvil 96 held in place by the brakes 100 acting on the die posts 102, the cylinder-and-piston assemblies 54 move the rivet support anvil 38 into position against the head 76 of the rivet 74, and the brake 62 is then actuated on the die post 56 to lock the rivet support anvil 38 in position, thus establishing the initial condition of the rivet support anvil 38 with respect to the parts support anvil 96, as shown in FIG. 10.

Thereafter, adjustment of the rivet support anvil 38 with respect to the parts support anvil 96, and operation of the riveting head 80, are the same as with the riveting machine 20 described previously, as the brakes 100 lock the parts support anvil 96 to the frame 94 so that it will support the parts being riveted, in opposition to the force of the riveting head 80.

Figure 11:
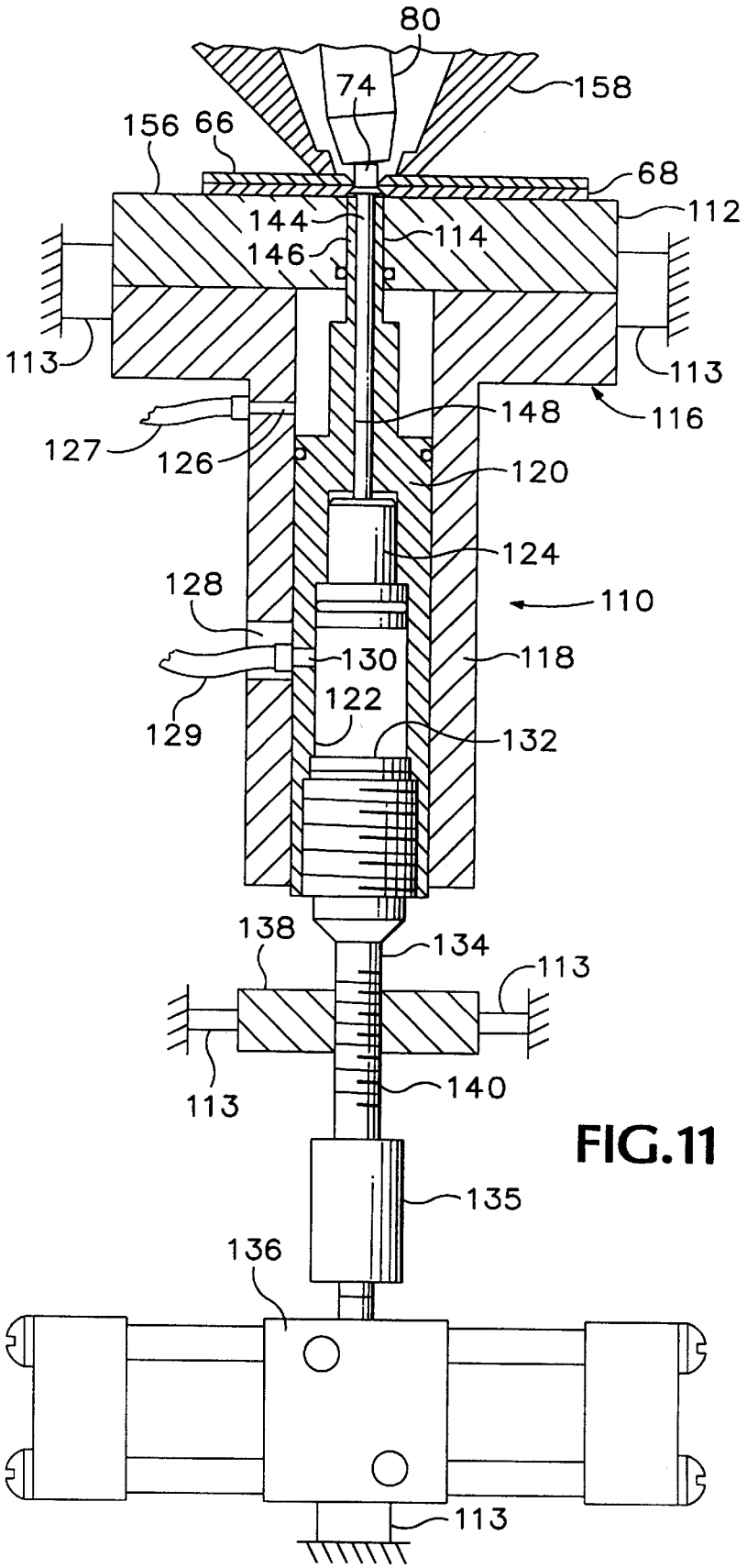
FIG. 11 is a sectional, simplified schematic view of a machine for use in forming a riveted joint according to a variation of the method of the present invention.
Figure 12:
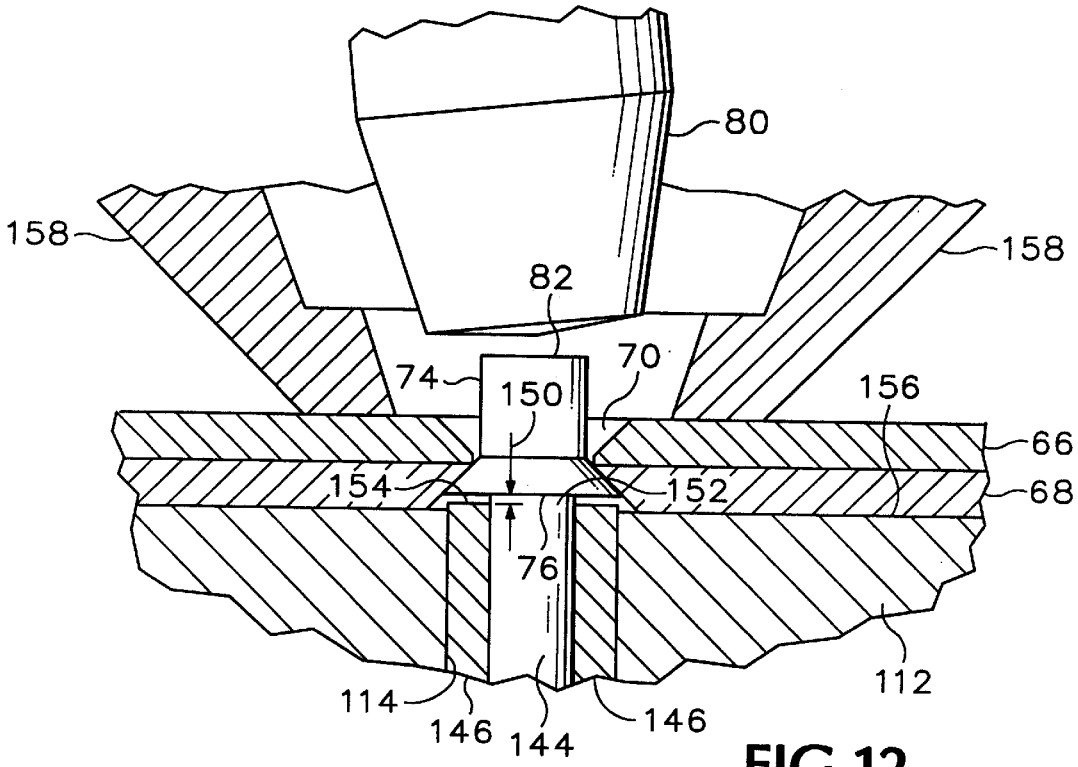
FIG. 12 is a sectional, simplified schematic view, at an enlarged scale, of certain parts of the machine shown in FIG. 11 during an initial step of the method of forming a riveted joint using that machine.
Figure 13:
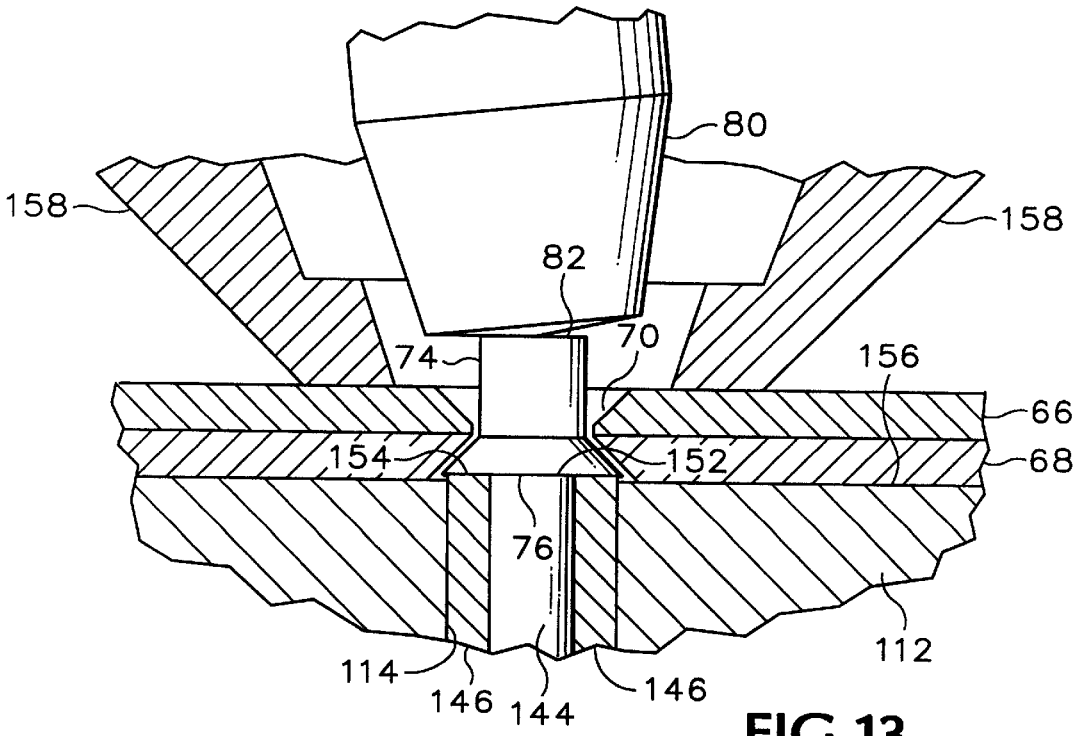
FIG. 13 is a view similar to FIG. 12 showing the relative positions of the same parts of the machine shown in FIG. 11 and of the rivet joint being formed according to the present invention using the machine shown in FIG. 11.

Formation of a rivet joint to assemble a group of parts such as the scissors blades 66 and 68 may also be accomplished according to the present invention using apparatus such as the riveting machine 110 shown in FIGS. 11, 12, and 13, in which a parts support anvil 112 of appropriate size attached to a rigid frame 113 (shown schematically) defines a throughbore 114. A rivet support assembly 116 is located beneath the parts support anvil 112 and includes a pneumatic cylinder 118, an outer piston 120, an inner cylinder 122 defined within the outer piston 120, and an inner piston 124 disposed movably within the inner cylinder 122. One end of the cylinder 118 is closed by the parts support anvil 112, and a port 126 for passage of pressurized gas to and from a conduit 127 communicates with the interior of the pneumatic cylinder 118 above the outer piston 120. A clearance aperture 128 provides access through the wall of the pneumatic cylinder 118 to an inner port 130 for passage of pressurized gas through a conduit 129 to and from the interior of the inner cylinder 122 beneath the inner piston 124. A plug 132 fitted into the outer piston 120 closes the inner cylinder 122 opposite the inner piston 124. A connecting rod 134 extends rotatably outward from the plug 132 and is connected through a slip joint coupling 135 to a motor, such as a rotary actuator 136 which may be driven by gas under controlled pressure, such as compressed air. The rotary actuator 136 drives the slip joint coupling 135, which in turn rotates the connecting rod 134 within a ball nut 138 which is engaged with ball screw threads 140 (shown schematically in FIG. 11) on the connecting rod 134. The rotary actuator 136 and the ball nut 138 are both supported on a single structure such as the frame 113 and are thus fixed with respect to each other, so that rotation of the connecting rod 134, with its threads 140 mated with the ball nut 138, moves the connecting rod 134 longitudinally, with respect to the frame 113 and the slip joint coupling 135 and thus moves the outer piston 120 longitudinally within the pneumatic cylinder 118.

Extending movably into the throughbore 114 from within the pneumatic cylinder 118 is a rivet support anvil including a central pin 144 and a sleeve or tubular outer pin 146 defining a bore 148 surrounding the central pin 144. The outer pin 146 is integral with the outer piston 120 and extends from it into the throughbore 114. The central pin 144 extends through the bore 148 as a rivet insertion member and is attached to the inner piston 124, so that movement of the inner piston 124 within the inner cylinder 122 moves the central pin 144 longitudinally along the bore 148 within the outer pin 146.

Except when riveting is actually taking place, a quantity of gas at a controlled pressure introduced through the port 130 into the interior of the inner cylinder 122 urges the inner piston 124 to the upper end of the inner cylinder 122 (as seen in FIG. 11), thus holding the central pin 144 extended as far out;as possible with respect to the surrounding outer pin 146, with a force of, for example, 60 pounds. The central pin 144 then protrudes beyond the outer pin 146 by an adjustment distance 150 as shown in FIG. 12. The adjustment distance 150 is selected to provide the desired clearance between the head 76 of a rivet 74 and the interior surface of the rivet hole 72 in the movable blade 68 when the rivet's outer end 82 is upset by a riveting head to form a second head on the rivet 74.

The riveting machine 110 is utilized by placing together and aligning a group of parts such as the first blade 66 and second blade 68 of a pair of scissors and inserting the rivet 74 into the rivet holes 70 and 72 provided respectively in the blades as previously described. The rotary actuator 136 is operated to retract the connecting rod 134 a short distance, thus bringing the respective outer ends 152 and 154 of the central pin 144 and outer pin 146 of the rivet support anvil to a recessed position with respect to the support surface 156. The blades 66 and 68 and the rivet 74 are then placed together on the parts support anvil 112, with the head 76 of the rivet aligned with the throughbore 114 and the movable blade 68 resting on the support surface 156 of the parts support anvil 112. When the group of parts and the rivet 74 are properly located on the support surface 156 a parts clamp 158 is lowered into contact with the scissors blades 66 and 68, pushing them together and into contact with the support surface 156 with some pressure, but not great enough pressure to deform them.

A quantity of gas under controlled pressure, such as compressed air, is admitted into the pneumatic cylinder 118 above the outer piston 120 through the conduit 127 and port 126, as well as being admitted also through the conduit 129 and port 130 into the inner cylinder 122 as previously described. The rotary actuator 136 is then operated to rotate the slip joint coupling 135, thus turning the threads 140 of the connecting rod 134 in the ball nut 138 as required to raise the connecting rod 134 and the attached outer piston 120, carrying with it the outer pin 146 and the central pin 144, with the central pin 144 projecting beyond the outer pin 146 as shown in FIG. 12. The downward force exerted by the gas under pressure within the pneumatic cylinder 118 above the outer piston 120 opposes the force of the ball screw so that the outer piston 120 is urged upward toward the head 76 of the rivet 74 with a net force of, for example, 30 pounds, which is less than the force urging the inner piston 124 upward with respect to the outer piston 120. The force of the gas above the outer piston 120 acts against the force of the actuator 136 and ball nut 138 to limit the net upward force of the rivet support anvil against the head 76 of the rivet.

As a result, the outer end 152 of the central pin 144 is brought into contact with the surface of the head 76 of the rivet 74 with a force less than the force required to overcome the force of gas under pressure in the inner cylinder 122, and the central pin 144 continues to extend beyond the outer pin 146. The downward force exerted by the parts clamp 158 is also greater than the net force upward on the head 76 of the rivet 74. Thus the upward pressure of the central pin 144 urges the rivet 74 snugly into engagement in the rivet hole 72 in the movable blade 68, while the outer end 154 of the outer pin 146 remains spaced apart from the head 76 of the rivet 74 by the adjustment distance 150 shown in FIG. 12.

Next, the riveting head 80 is moved downward into contact with the outer end 82 of the rivet 74. This initially forces the rivet 74 downward, overcoming the force of the compressed air within the inner cylinder 122 and forcing the center pin 144 down within the outer pin 146 until the outer end 152 of the center pin 144 is flush with the outer end 154 of the outer pin 146, as illustrated in FIG. 13, allowing the head 76 of the rivet 74 to come also into contact with the outer end 154 of the outer pin 146. The rotary actuator 136 and ball nut 138 retain the outer piston 120 and thus the outer pin 146 in its position with respect to the rivet 74 and the parts support anvil 112 as the riveting head 80 upsets the outer end 82 of the rivet and forms the second head 84.

Because the outer pin 146 moves together with the central pin 144 until the outer end 152 is brought into contact with the head 76 and urges the rivet 74 fully into contact against the inner surface of the rivet hole 72, prior to the riveting head 80 being brought into contact with the outer end 82 of the rivet 74, the available amount of movement of the rivet 74 until its head 76 comes into contact with the outer end 154 is always equal to the desired adjustment distance 150, regardless of the actual location of the head 76 of the rivet 74 with respect to the support surface 156 on which the movable blade 68 rests in the initial condition established before the riveting head 80 is brought to bear on the outer end 82 of the rivet 74.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A method of riveting a plurality of parts together to form an assembly with a predetermined clearance or interference between a rivet and the parts interconnected by the rivet, comprising:

(a) urging together a parts clamp and a parts support anvil on opposite sides of a plurality of parts to be riveted together;

(b) urging a rivet anvil against a first head of a rivet, thereby urging the rivet into a rivet hole extending through the parts to be riveted together and establishing an initial condition;

(c) thereafter adjusting said rivet anvil with respect to said parts anvil, thereby creating an adjusted condition; and (d) thereafter forming a second head on said rivet while retaining said parts support anvil and said rivet anvil in said adjusted condition.

2. The method of claim 1, including the step of pushing said rivet toward said rivet support anvil after adjusting said rivet support anvil and before forming said second head.

3. The method of claim 1 wherein said step of adjusting includes moving one of said rivet support anvil and said parts support anvil with respect to the other.

4. The method of claim 1, including the step of applying force to said rivet axially in a direction tending to move said rivet toward said first head after adjusting said rivet support anvil and before forming said second head.

5. The method of claim 1, including the steps of locking the parts support anvil and parts clamp relative to a frame and thereafter adjusting said rivet anvil relative to said parts support anvil by adjusting said parts support anvil with respect to the frame.

6. The method of claim 1 wherein said step of adjusting includes moving said rivet anvil by a predetermined distance relative to said parts support anvil.

7. The method of claim 1, including the step of locking the position of said parts clamp relative to said parts support anvil, wherein said step of adjusting includes thereafter adjusting the position of said rivet anvil relative to the position of said parts support anvil.

8. The method of claim 7, including the step of locking the rivet support anvil into said initial condition prior to said step of adjusting.

9. The method of claim 1 wherein said step of adjusting includes adjusting the position of said rivet support anvil relative to the position of said parts anvil by moving an eccentric wheel included in a rivet support anvil assembly.

10. The method of claim 1 wherein said step of adjusting includes adjusting the position of said rivet support anvil relative to the position of said parts support anvil by moving a cam wheel included in a rivet support anvil assembly.

11. The method of claim 1 wherein said step of adjusting includes adjusting the position of said rivet support anvil relative to the position of said parts anvil by moving a crank included in a rivet support anvil assembly.

12. The method of claim 1 wherein said step of adjusting includes adjusting the position of said rivet anvil relative to the position of said parts support anvil by operating a screw mechanism.

13. The method of claim 1, including the step of locking the parts support anvil and parts clamp relative to a frame and thereafter adjusting said rivet anvil relative to said parts support anvil by adjusting said parts support anvil with respect to the frame.

14. A method of riveting a plurality of parts together to form an assembly with a predetermined clearance or interference between a rivet and the parts, comprising:

(a) clamping together a group of parts;

(b) providing a set of aligned rivet holes in the parts to be joined;

(c) inserting a rivet through said set of aligned rivet holes;

(d) supporting the group of parts on a parts support anvil;

(e) urging a rivet support anvil against a preformed head of said rivet, thereby urging said rivet into said rivet holes and establishing an initial condition of said rivet support anvil with respect to said parts support anvil while supporting said preformed head of the rivet independently of supporting said group of parts on said parts support anvil;

(f) thereafter, adjusting the rivet support anvil with respect to the parts support anvil such that there will be a desired clearance in the rivet; and (g) thereafter, forming a second head on said rivet on a side of said group of parts opposite said parts support anvil while said rivet support anvil supports said preformed head of said rivet adjacent said parts support anvil but independently thereof.

15. A method of riveting a plurality of parts together to form an assembly with a predetermined clearance or interference, comprising:

(a) clamping a group of parts together against a parts support anvil;

(b) providing a set of aligned rivet holes in the ones of said group of parts;

(c) inserting a rivet through said set of aligned rivet holes;

(d) pushing a pressing face of a rivet insertion member against a first head of the rivet with an insertion force of a first magnitude;

(e) placing a rivet support face of a rivet support anvil in a position aligned with the rivet and spaced a predetermined distance apart from the rivet and the pressing face of the rivet insertion member;

(f) holding said rivet support anvil stationary with respect to said parts support anvil; and (g) thereafter, exerting pressure against an opposite end of the rivet, thus overcoming said insertion force and moving the first head of the rivet into contact with said rivet support face, and thereafter forming a second head on said rivet while said first head remains in contact with said rivet support face.

16. The method of claim 15, including the step of supporting said rivet insertion member in said position with respect to said rivet support face by applying a force greater than said first magnitude between said rivet support anvil and said rivet insertion member.

17. The method of claim 15, including the step of moving said rivet support anvil and said rivet insertion member as a unit during said step of pushing said rivet insertion member against said first head.

18. The method of claim 15, including the step of using a screw to move said rivet support anvil toward said rivet with a force no greater than said first magnitude, and to hold said rivet anvil stationary during said step of forming said second rivet head.

19. Apparatus for forming a riveted joint fastening together a plurality of parts, the apparatus comprising:

(a) a supporting structure;

(b) a parts support anvil supported by said supporting structure;

(c) a rivet support anvil located adjacent said parts support anvil and supported by said supporting structure;

(d) a parts clamp member disposed opposite said parts support anvil, at least one of said parts support anvil and parts clamp member being movable with respect to the other and with respect to said supporting structure;

(e) a lock arranged to hold said rivet support anvil in an initial rivet-supporting position;

(f) a rivet support anvil adjustment mechanism interposed between said frame and said rivet support anvil; and (g) a rivet head forming device disposed opposite said rivet support anvil in position to form a second head on a rivet having a first head supported on said rivet support anvil.

20. The apparatus of claim 19, further including a second lock arranged to hold said movable one of said parts clamp and said parts support anvil in a parts clamping position with respect to the other.

21. The apparatus of claim 19 wherein said lock is located so as to hold said rivet head support anvil in said initial rivet-supporting position with respect to said frame.

22. The apparatus of claim 19 wherein said lock is located so as to hold said rivet head support anvil in said preliminary rivet head supporting position with respect to said parts support anvil.

23. The apparatus of claim 19, including a first motor arranged to urge said movable one of said parts support anvil and said parts clamp toward the other with a predetermined force.

24. The apparatus of claim 23, including a second motor arranged to move said rivet anvil toward said parts clamp with a second force which is less than said predetermined force.

25. Apparatus for forming a riveted joint fastening together a plurality of parts, the apparatus comprising:

(a) a parts support anvil;

(b) a parts clamp arranged to hold a group of parts against said parts support anvil;

(c) a rivet support anvil having a rivet support face; and (d) a rivet insertion member included in said rivet support anvil and having a pressing face protruding a predetermined distance beyond said rivet support face and resiliently movable toward said rivet support face.

26. The apparatus of claim 25 wherein said rivet insertion member is a central rod located within an axial bore defined within an outer part of said rivet support anvil.

27. The apparatus of claim 25 wherein said rivet insertion member is supported with respect to said rivet support anvil by a contained quantity of a fluid under pressure.

28. The apparatus of claim 27, wherein said quantity of a fluid under pressure is contained within a cylinder-and-piston assembly.

* * * * *

UNITED STATES PATENT AND TRADEMARK OFFICE

CERTIFICATE OF CORRECTION

PATENT NO : 5,855,054

DATED : January 5, 1999

INVENTOR(S) : Rivera, et al.

It is certified that error appears in the above-identified patent and that said Letters Patent is hereby corrected as shown below:

| | |
|---|---|
| Col. 3, Line 27 | change "the.present" to read --the present-- |
| Col. 5, line 51 | change "the.parts" to read --the parts-- |
| Col. 6, line 18 | change "not.so" to read --not so-- |
| Col. 9, line 23 | change "out;as" to read --out as-- |

Signed and Sealed this

Fourth Day of April, 2000

*Attest:*

Q. TODD DICKINSON

*Attesting Officer*

*Director of Patents and Trademarks*

UNITED STATES PATENT AND TRADEMARK OFFICE
CERTIFICATE OF CORRECTION

PATENT NO : 5,855,054

DATED : January 5, 1999

INVENTOR(S) : Benjamin C. Rivera, et al.

It is certified that error appears in the above-identified patent and that said Letters Patent is hereby corrected as shown below:

| | |
|---|---|
| Col. 12, Line 56 | change "frame" to read --supporting structure-- |
| Col. 12, Line 67 | change "frame" to read --supporting structure-- |

Signed and Sealed this

Fifth Day of December, 2000

*Attest:*

Q. TODD DICKINSON

*Attesting Officer*

*Director of Patents and Trademarks*